United States Patent [19]

Crocker et al.

[11] Patent Number: 4,462,749

[45] Date of Patent: Jul. 31, 1984

[54] PIPE HANDLING APPARATUS

[76] Inventors: Roger A. Crocker; Jim Schoolcraft, both of Box 37, Wickett, Tex. 79788

[21] Appl. No.: 400,347

[22] Filed: Jul. 21, 1982

[51] Int. Cl.[3] ..... E21B 19/14

[52] U.S. Cl. ..... 414/748; 198/360; 414/22

[58] Field of Search ..... 414/22, 745, 748; 198/360, 485

[56] References Cited

U.S. PATENT DOCUMENTS

| | | | |
|---|---|---|---|
| 1,901,360 | 3/1933 | Snow | 414/748 |
| 2,852,147 | 9/1958 | Maydew | 414/22 |
| 3,774,780 | 11/1973 | Buffington | 414/22 |
| 4,051,956 | 10/1977 | Teague | 414/748 |
| 4,054,210 | 10/1977 | Crocker | 414/22 |
| 4,140,227 | 2/1979 | Beck | 414/22 |

*Primary Examiner*—Leslie J. Paperner

*Attorney, Agent, or Firm*—Pravel, Gambrell, Hewitt, Kirk & Kimball

[57] ABSTRACT

A pipe handling apparatus comprising a plurality of pipe supports having articulated arms for lifting a joint of pipe and moving it laterally across a recess by means of a temporary support spanning the recess and thereafter moving the pipe back into a trough received in the recess. The apparatus also includes means for tipping trough to roll out a joint of pipe carried therein and inclined guide means for guiding and directing the pipe as it is discharged from the trough.

2 Claims, 5 Drawing Figures

53d
53b
T
55
53
53a
D
T
54
52
51
41
50
R
M-1
M-2
F
D
P
C

PIPE HANDLING APPARATUS

SUMMARY

A pipe handling apparatus comprising a pair of spaced apart pipe support stands adapted to be positioned on a catwalk and having articulated arms for lifting a joint of pipe from a position adjacent the stands onto to the inclined top of the stands causing the pipe to roll across the stands to a movable stop projecting above the inclined tops. The inclined tops are provided with a central recess for receiving a pipe trough and also having temporary bridge means spanning the recess to carry pipe from one side of the recess to the other. The stands also include means for moving the stops laterally to roll the pipe up the inclined tops into a trough positioned in the central recesses.

BACKGROUND OF THE INVENTION

The pipe handling apparatus of the present invention is useful in moving pipe laterally on a catwalk or pipe rack and loading such pipe into a pipe receiving trough of a pickup and laydown machine such as that illustrated in U.S. Pat. No. 4,054,210. The pickup and laydown machine shown and described there employs a mast or pole which supports the upper end of the main support cable along which the pipe carrying trough moves. This mast is conventionally inserted in the mouse hole nearby the rotary in the rig floor. In those instances where the mouse hole is positioned to one side of the center line of the catwalk, the trough is positioned so that it is difficult to load the trough from the backside or the side on which the trough support arms are connected. It requires that each joint of pipe must be moved across the catwalk to the open or opposite side of the trough from the support arms to enable the pipe to be rolled into the trough to load it. The present invention alleviates this problem by providing an apparatus for quickly and easily moving the pipe laterally across the center line of the catwalk from one side to the other and for rolling the pipe back into the open side of the trough once it is positioned in the recess in the pipe handling apparatus.

DESCRIPTION OF THE PREFERRED EMBODIMENT

Figures 1, 2:
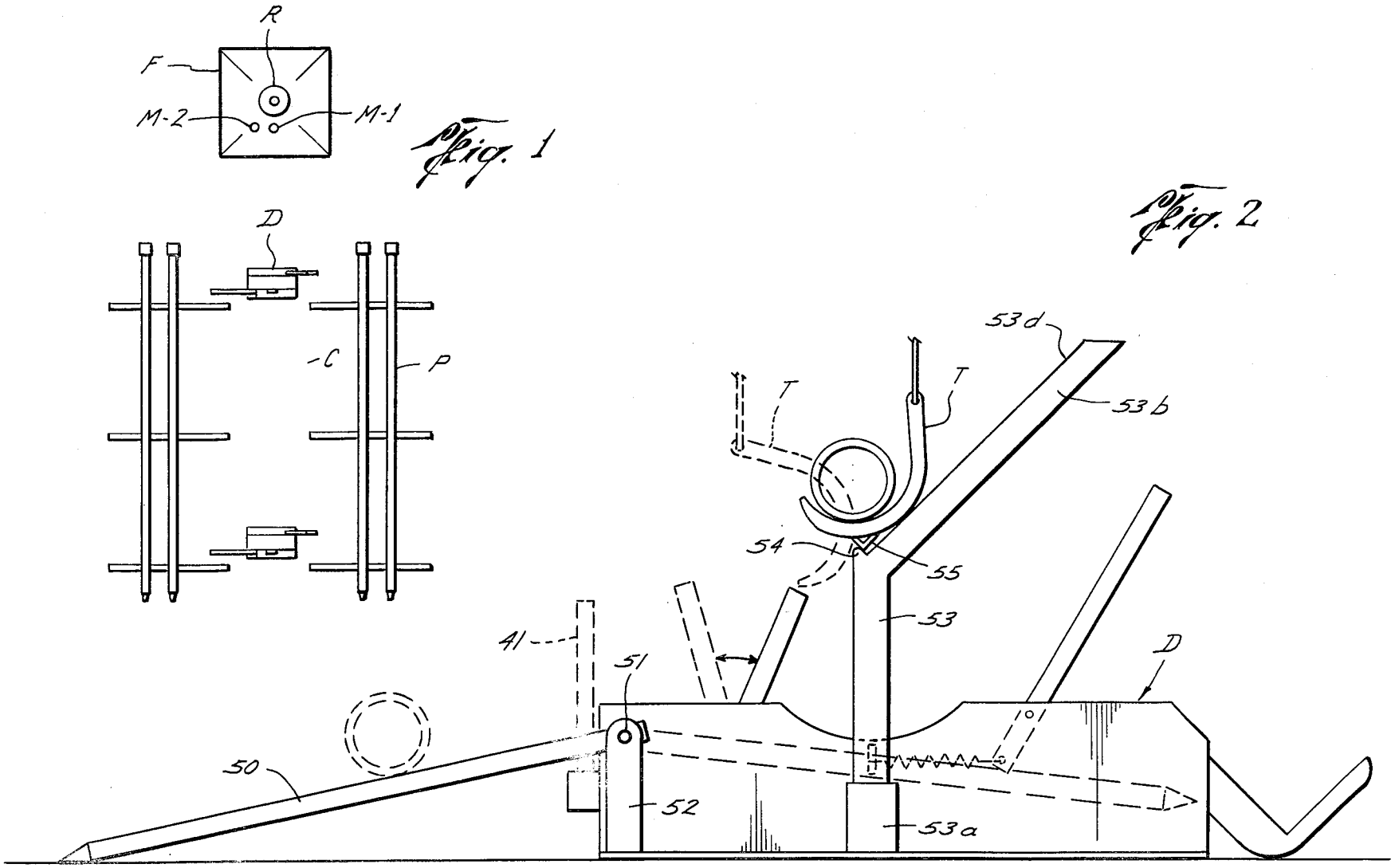
FIG. 1 is a plan view showing a rig floor and its orientation with respect to adjacent pipe racks and cat walks.
FIG. 2 is a side elevation showing parts of the apparatus in phantom.

The present invention comprises a pair of spaced apart pipe handling devices designated generally D in FIG. 1 of the drawings. Such pipe handling devices are positioned in spaced relationship on a catwalk C which is adjacent the floor F of a drilling rig. The mouse hole may be located either at M-1 or M-2 on the floor F and apparatus of this invention is primarily useful in those situations when the mouse hole is located at M-2 which is somewhat off center of the center line from the rotary R and the catwalk C. The pipe handling devices D positioned on the catwalk C received joints of pipe stored on the pipe racks P adjacent the catwalk C.

In those instances when the mouse hole is located in a position illustrated M-2 in the rig floor the overhead support cable which is attached to the mast seated in the mouse hole M-2 is aligned off-center and to one side of the rotary R. This alignment presents a problem when loading pipe into the trough (not shown) from the pipe rack adjacent the backside of the trough on which the support arms are secured.

Figure 3:
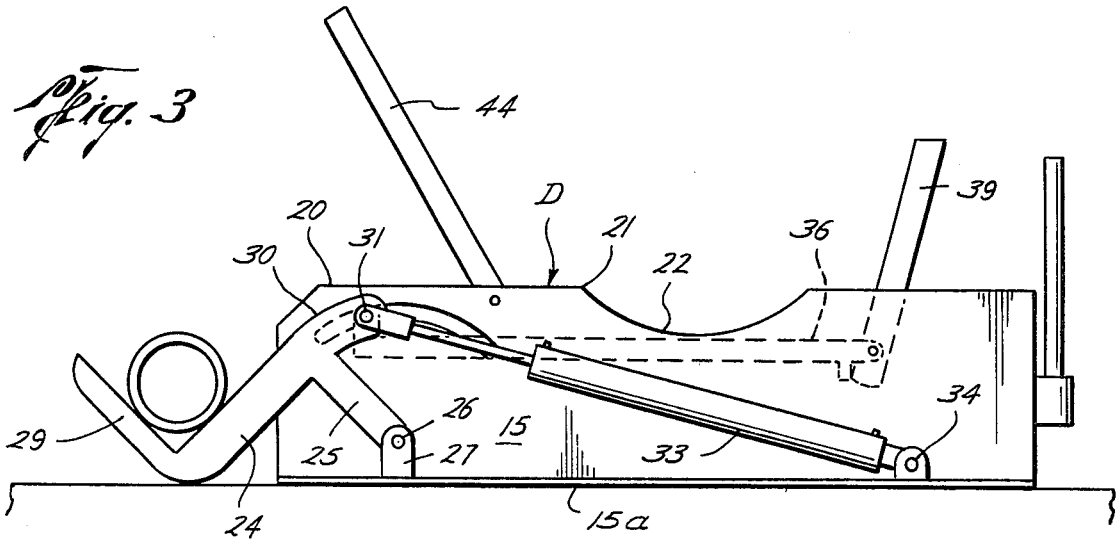
FIG. 3 is a side elevation showing one of the stands with the lift arm in the intermediate position with a pipe cradled therein.
Figure 4:
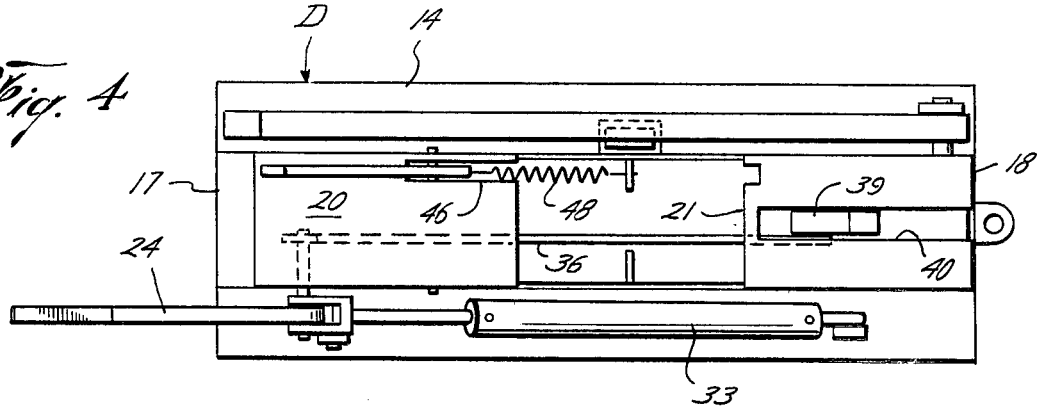
FIG. 4 is a top view of the apparatus illustrated in FIG. 3.

The pipe handling devices D facilitate transfer of a joint of pipe laterally across the catwalk and, as shown in FIGS. 2 through 5, in the preferred embodiment, each device D comprises a housing or pipe stand having parallel sides 14 and 15 secured together in spaced relation at their opposite ends by means of transverse ends 17 and 18. If desired, a bottom 19 is secured to the lower edge of the sides 14 and 15 and, as shown in FIG. 3, if desired, the sides may be provided with suitable laterally extending flange members such as 15A at the lower most edge of each of the sides to provide feet to support and stabilize the pipe stand D.

The stand D has an inclined upper surface 20 which extends downwardly from the left to the right as seen in FIG. 3 to cause a pipe placed thereon to roll by gravity across the pipe stand to the righthand side. The upper surface has an opening 21 therein which extends between the upper edges of the arcuate opening 22 in each of the sides 14 and 15 to provide a recess for receiving a pipe handling trough when positioned thereon for loading and unloading pipe.

Adjacent one end of the housing D is a lift arm 24 which comprises a central member having an upper arm 25 projecting laterally therefrom and pivotally mounted to the housing D by means of pivot pin 26 carried in the ear 27 which is welded or otherwise secured to the housing D. A lower pipe receiving arm 29 projects laterally in the opposite direction from the lower end of the arm 24 to cradle a joint of pipe to lift it upwardly to the top of the housing 20 when the lift arm is pivoted about its pin 26. An upper link 30 also extends from the upper end of the arm 24 and is provided for receiving a pin 31 which pivotally connects the lift arm 24 to pivot means 33 which preferably comprises a hydraulic cylinder mounted on the housing by pivot pin 34. Actuation of the double acting hydraulic cylinder 33 moves the lift arm from a lower position to the intermediate position shown in FIG. 3 and then upwardly to the elevated position shown in FIG. 5 and back.

Attached to the lift arm 24 also by pin 31 is the link 36 which is connected at its opposite end to the upstanding finger 39 which extends through a slot 40 in the top 20 and projects above the top 20 as shown in FIG. 3. The finger 39 moves longitudinally of its slot 40 in conjunction with the movement of the lift arm 24. Thus, when the left arm 24 is moved from the lower position to the intermediate position (FIG. 3) and thence to the upper (FIG. 5) position the finger 39 is moved by the connecting link 36 laterally from a position at the left end of the slot 40 (FIG. 4) adjacent the opening 21 to a position at the rear end of the slot illustrated in FIG. 5. A stop pin 41 is provided on the end of the housing opposite from the lift arm 24 as a means for preventing a joint of pipe from rolling off of that end of the housing. When the lift arm 24 is moved from the upper (FIG. 5) to the lower (FIG. 3) position, the finger 39 moves back across the top of the housing 20 to roll a joint of pipe into the trough setting in the arcuate opening 22.

A bar 44 is pivotally mounted in the stand D and extends through a slot 46 in the top 20 to provide a temporary bridge to span the arcuate opening 22 and provide a support means to carry a joint of pipe across the arcuate opening prior to its being loaded into the trough by lateral movement of the finger 39. The bar 44 is provided with spring means 48 for urging the bar 44 into the upright position shown in FIG. 3 of the drawings. The spring 48 is depressed by the weight of a joint of pipe to allow the bar 44 to swing down to temporarily span the arcuate opening 22 and the bar 44 swings back up to its upright position when the pipe is rolled off the end of the bar 44 and it is thereby unloaded. Thereafter pivoting the lift arm from its raised (FIG. 5) position to a lower position (FIG. 3) or to a lower position will cause the link 36 to draw the finger 39 laterally of the housing to move the pipe laterally into the trough T which has been positioned in the arcuate opening 22.

OPERATION OF THE APPARATUS OF THE PRESENT INVENTION

Figure 5:
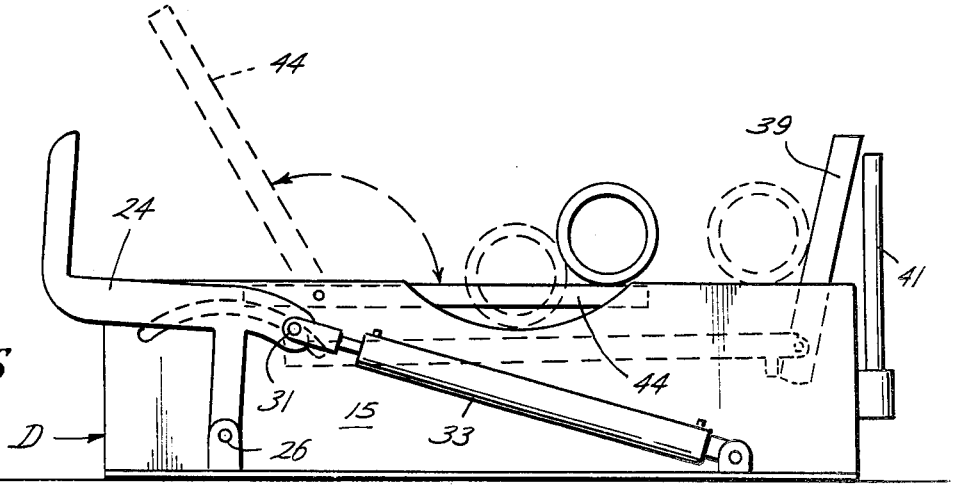
FIG. 5 is a side elevation with the lift arm moved to the upper position.

The operation of the pipe transfer apparatus of the present invention begins with a pair of the housings D positioned at spaced relationship on the catwalk C between or adjacent to one or more pipe racks. The lift arms 24 are initially positioned in their lowermost position for receiving or cradling a pipe as shown in FIG. 3. It will be appreciated that when the lift arm 24 is in its lowermost position the member 29 is in a substantially horizontal position for initially receiving the pipe. Thereafter, as the lift arm is pivoted upwardly the pipe is cradled between the arms 24 and 29 and carried upwardly into a position where it is rolled onto the inclined top 20 of the lift stands. Movement of the pipe across the upper corner of the left stand into engagement with the retractable bar 44 will cause such bar to swing over into a horizontal position as shown in FIG. 5 to provide a temporary support spanning the recessed opening 22. As shown in FIG. 5 the pipe in position illustrated by A is resting on the depressed temporary support bar 44 as it rolls down the inclined surface 20 to the position illustrated at B where the pipe is resting against the finger 39. After the pipe A is rolled off the end of the bar 44 it will be pivoted by its spring 48 to the upright position illustrated in phantom in FIG. 5 and also illustrated in FIG. 3 thereby leaving the arcuate recess 22 open for receiving the pipe trough. With the pipe trough in position in the arcuate opening 22 the arm 24 is moved downwardly and the link 36 pulls the finger 39 laterally thereby moving the pipe up the inclined surface 20 into the trough (not shown) which has been positioned in the arcuate opening 22 thereby moving the pipe into the position illustrated at C in FIG. 5.

As shown in FIG. 2 of the drawings, the apparatus is also provided with a short pipe ramp 50 which is an arm pivotally mounted by the pin 51 on the upstanding ear 52 welded or otherwise secured to one end of the pipe stand D. A tilting arm 53 is mounted in a suitable opening **53*a* on the pipe stand. Such tilting arm 53 includes an upstanding member having an inclined bar 53*b* extending upwardly and outwardly at the upper end of the arm 53. An unwardly projecting lug 54 is positioned on the upper end of the arm 53 at the end of the upper surface of the inclined arm 53*b*. Such lug 54 is provided for engaging the trip bar 55 which is welded or otherwise secured to the bottom of the trough T. When the trough is lowered by its overhead support cable into engagement with the upper surface 53*b* of the inclined arm 53*b* the trough will then slide downwardly until its trip bar 55 engages the lug 54 at which time the trough is tilted into the position illustrated in phantom at T' in FIG. 2 of the drawings. Discharging the pipe from the open side of the trough. The end stop 41 is removed and the arm 50 is pivoted into its outward position as shown in FIG. 2 to thereby cause the pipe discharge from the tilted trough T' to roll off of the stand and downwardly along the inclined arm 50** to return the pipe to storage on a pipe rack or other suitable storage facility.

We claim:

1. A pipe handling apparatus for laterally shifting a joint of pipe comprising:

(a) base means having an upstanding member with an upper inclined surface with a central opening in said upper surface for receiving a pipe trough;

(b) first pipe receiving means for moving a joint of pipe onto said upper inclined surface;

(c) movable means for temporarily spanning said opening in said upper surface to support a joint of pipe as it moves across said opening in said upper surface;

(d) second pipe moving means mounted in said base for moving a joint of pipe upwardly along said upper inclined surface towards said central opening for moving a joint of pipe into a pipe trough received in said central opening, (e) a pipe engaging arm pivotally mounted on said base for moving said first pipe engaging arm to lift a joint of pipe onto the upper surface of said housing;

and (f) link means connecting said first pipe moving means and said second pipe moving means whereby said first and second pipe moving means are moved together.

2. A pipe handling apparatus for laterally shifting a joint of pipe comprising:

(a) base means having an upstanding member with an upper inclined surface with a central opening in said upper surface for receiving a pipe trough;

(b) first pipe receiving means for moving a joint of pipe onto said upper inclined surface;

(c) movable means for temporarily spanning said opening in said upper surface to support a joint of pipe as it moves across said opening in said upper surface;

(d) second pipe moving means mounted in said base for moving a joint of pipe upwardly along said upper inclined surface towards said central opening for moving a joint of pipe into a pipe trough received in said central opening, (e) the pipe moving means includes link means connecting said first pipe moving means and second pipe moving means.

* * * * *